United States Patent [19]

Haws

[11] Patent Number: 5,005,924

[45] Date of Patent: Apr. 9, 1991

[54] DRAWER COMB HOLDER

[76] Inventor: Henry H. Haws, 531 S. Mesa Dr., Mesa, Ariz. 85210

[21] Appl. No.: 291,153

[22] Filed: Dec. 28, 1988

[51] Int. Cl.[5] ..... A47B 83/00

[52] U.S. Cl. ..... 312/237; 312/330.1

[58] Field of Search ..... 312/138 A, 237, 206; 206/38, 235, 349; 297/188, 194; 211/13

[56] References Cited

U.S. PATENT DOCUMENTS

| | | | |
|---|---|---|---|
| D. 140,524 | 3/1945 | Taylor | 297/194 |
| 1,557,292 | 10/1925 | Little | 211/13 X |
| 1,868,904 | 2/1932 | Johnston | 297/188 X |
| 2,456,850 | 12/1948 | Willis | 211/13 |
| 2,592,203 | 4/1952 | Snyder | 211/13 |
| 3,164,427 | 1/1965 | Norman | 312/209 |
| 3,719,283 | 3/1973 | Urda | 211/13 |

*Primary Examiner*—Joseph Falk

*Attorney, Agent, or Firm*—Grant L. Hubbard

[57] ABSTRACT

A drawer comprising a generally vertical front wall, and a holder mounted thereupon for holding a hand comb which has a lower edge defined by protruding comb teeth and an upper edge defined by a back for grasping and holding the comb, the holder also being capable of use in association with any generally vertical wall, is disclosed.

7 Claims, 1 Drawing Sheet

DRAWER COMB HOLDER

BACKGROUND OF THE INVENTION

This invention relates to hand comb holders and specifically to a specially configured drawer and comb holder construction for holding hand combs inside and adjacent the front wall of a drawer at a angle of from about 15 to about 50 degrees from the generally vertical front of a drawer, or other supporting wall.

The fundamental law nature that inanimate objects are naturally perverse to the needs and desires of mankind dictates that the ordinary hand comb, no matter how carefully place in a drawer, always crawl out of sight under every other object in a drawer. The law which necesitates this obstinacy and perversity of the homely hand comb is actuated by the well-known and unscientifically proven fact that the hand comb is the most frequently used of all objects normally kept in a dressing table or bathroom drawer, this law of nature dictating that the most frequently objects always be the most difficult to locate.

Recognizing that he may be risking the wrath of nature and nature's most extreme retribution, the inventor has, nevertheless, countermanded one of nature's most fundamental laws. This invention overcomes the immutable and ubiquitous vexation attendant to subduing the recalcitrant hand comb in a drawer or the like by providing a holder for positioning the comb in ready reach and easy access inside the front wall of a drawer or upon any generally vertical wall.

SUMMARY OF THE INVENTION

The invention, in its preferred form, is a drawer comprising a generally vertical front wall, and a holder mounted thereupon for holding a hand comb which has a lower edge defined by protruding comb teeth and an upper edge defined by a back for grasping and holding the comb. The holder, which may be incorporated into or attached to the drawer, or attached to any generally vertical surface comprises a first narrow elongate bottom strip from about four to about ten inches long and from about 0.1 to about 0.4 inches wide, the strip having first and second ends and front and rear edges, a first front wall substantially the length of the first bottom and from about one-half to about one and one-half inches in width having a bottom edge secured along the front of the bottom strip, a top edge and first and second ends, first and second trapezoidal ends each having a base edge, a top edge longer than the base edge, an altitude and front and rear edges, the base edges being secured at the respective ends of the bottom strip and the front edges secured to the respective ends of the front wall, and means for mounting the rear edges of the bottom and of the ends adjacent a generally vertical wall for use, the bottom, ends and front being so constructed and dispose relative to each other that when the holder is mounted for use the front wall upwardly from the bottom and outwardly from the vertical wall at an angle of from about 15 to about 50 degrees and defining an elongate receptacle for holding a comb therein lower edge down lying at an angle of from 15 to about 50 degrees from vertical for exposing the upper edge for easy grasping by the user.

In the preferred form, the upper edge of the front is configured to define a central area therein which is lower than the ends for permitting easy grasping of a comb when the hold is in use and the altitude of one end is shorter than the altitude of the other end piece, the bottom, ends and front being so configured and constructed as to permit the handle a tail comb to extend over the shorter end out of the receptacle defined by the bottom, ends and front.

Also in the preferred form the holder further comprises a second narrow elongate bottom strip from about four to about ten inches long and from about 0.1 to 0.4 inches wide, the strip having first and second ends and front and rear edges, a second front wall substantially the length of the first bottom and from about one-half to about one and one-half inches in width having a bottom edge secured along the front of the bottom strip, a top edge and first and second ends, third and fourth trapezoidal ends each having a base edge, a top edge longer than the base edge, an altitude and front and rear edges, the base edges being secured at the respective ends of the bottom strip and the front edges secured to the respective ends of the front wall, the second bottom, third and fourth ends and second front being so constructed and dispose relative to each other that when the holder is mounted for use the first front wall is disposed at an angle of from about fifteen to about 30 degrees from vertical and the second front extends upwardly from the second bottom and outwardly from the first front at an angle of from about 15 to about 30 degrees, the second bottom, third and fourth ends, first front and second front defining a second elongate receptacle for holding a comb therein lower edge down lying at an angle of from about 15 to about 50 degrees from vertical for exposing the upper edge for easy grasping by the user.

Other features of the invention are described in more detail hereinafter and are shown in the drawings.

DESCRIPTION OF THE PREFERRED EMBODIMENTS

It will be understood that only the preferred embodiments of the invention are shown and described, and that many variations may be made in dimensions, materials, etc., without departing from the invention.

Figure 1:
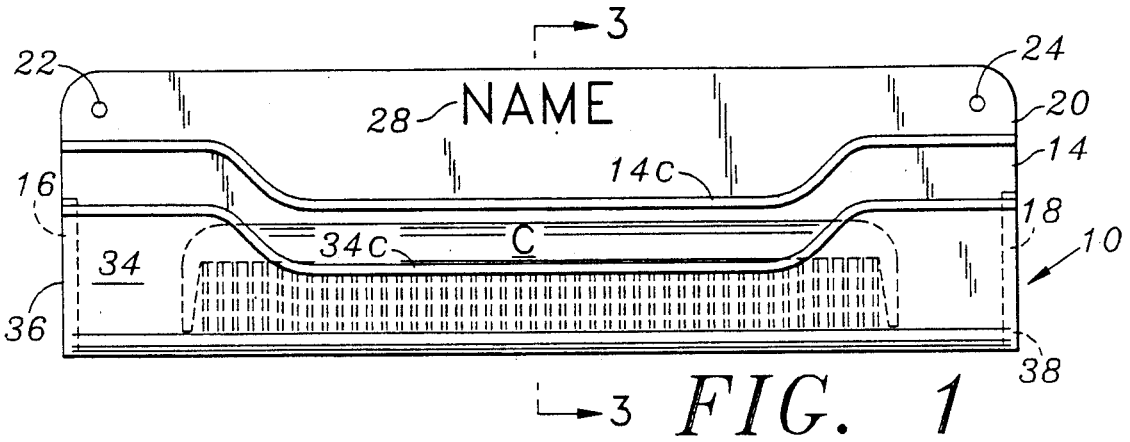
FIG. 1 is a front plane view of a preferred form of the holder of the invention.
Figure 2:
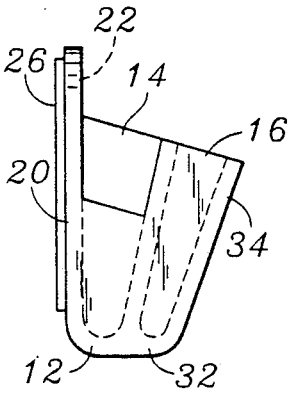
FIG. 2 is an end view of the holder shown in FIG. 1.
Figure 3:
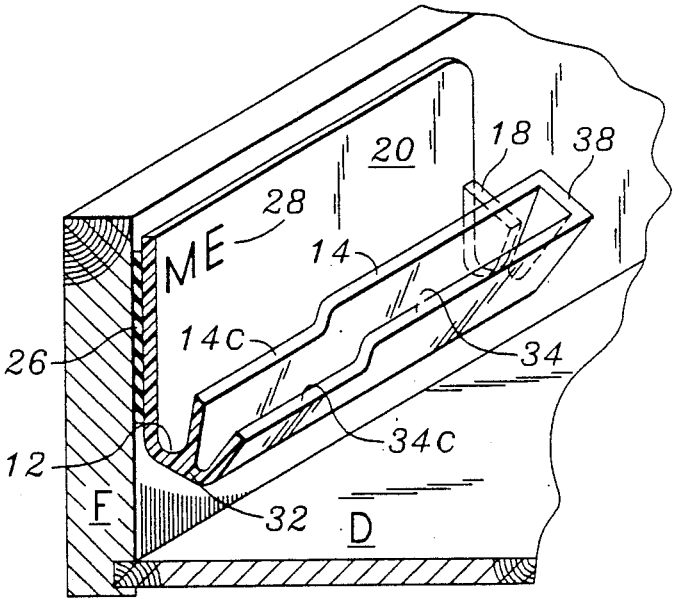
FIG. 3 is a cross-sectional view of the preferred form of the invention comprising the front end of a drawer combined with the holder, the holder being of the type shown in FIG. 2 and cross-sectioned along lines 3—3 in the direction of the arrows.

Referring first to FIGS. 1 through 3, the invention is preferably in the form of a drawer, D, which has integrally formed therewith or attached thereto so as to become integral with the inside of the front wall F of the drawer D a holder 10.

The holder 10 is so constructed and configured to be mounted in a generally vertical orientation relative to the surface of a dwelling or business building floor for holding a hand comb which has a lower edge defined by protruding comb teeth and an upper edge defined by a back for grasping and holding the comb. The holder comprises a first narrow elongate bottom strip 12 from about four to about ten inches long and from about 0.1 to about 0.4 inches wide, the strip having first and second ends and front and rear edges. A first front wall 14 substantially the length of the first bottom and from about one-half to about one and one-half inches in width is secured along the bottom edge to the front of the bottom strip 12, a top edge and first and second ends. First and second trapezoidal ends 16 and 18 each having a base edge, a top edge longer than the base edge, an altitude and front and rear edges, the base edges being secured at the respective ends of the bottom strip 12 and the front edges secured to the respective ends of the front wall 14. Means such as, for example, the back wall 20, are provided for mounting the rear edges of the bottom and of the ends adjacent a generally vertical wall for use, the bottom, ends and front being so constructed and dispose relative to each other that when the holder is mounted for use the front wall upwardly from the bottom and outwardly from the vertical wall at an angle of from about 15 to about 50 degrees and defining an elongate receptacle for holding a comb therein lower edge down lying at an angle of from about 15 to about 50 degrees from vertical for exposing the upper edge of a comb C for easy grasping by the user.

A back wall 20, separate from the vertical wall of the drawer or other generally vertical wall is not necessary, as the vertical wall may serve as the back wall, but such a back wall is convenient. The back wall, if provided, comprises an elongate back 20 substantially the same length as the first bottom, the back having a lower edge secured along the rear edge of the first bottom and the ends thereof to the rear edges of the first and second ends, the back comprising means for lying on the vertical wall and mounting comb holder thereto. The mounting means may also comprise apertures 22 and 24 for receiving screws and/or a thick, resilient two-sided adhesive strip 26, simply an adhesive bond, or any other convenient fastening means.

A convenient and attractive feature of the invention are indicia such as indicated at 28 which may be the name of the user. One or more such holders may be provided for each user presenting the rare opportunity for every comb to have its place and every comb to be in its place. It will be recognized immediately that such a concept runs counter to one of the fundamental laws of physics sometimes referred to as entropy which is to the effect that matter tends to flow from a state of organization to a state of disorganization.

The upper edge of the front 14 is preferably configured to define a central area 14*c* therein which is lower than the ends for permitting easy grasping of a comb when the holder is in use.

In an especially preferred form of the invention the altitude of one end is shorter than the altitude of the other end piece, the bottom, ends and front being so configured and constructed as to permit the handle a tail comb to extend over the shorter end out of the receptacle defined by the bottom, ends and front.

As clearly depicted in FIGS. 1–3, the comb holder further comprises a second narrow elongate bottom strip 32 from about four to about ten inches long and from about 0.1 to about 0.4 inches wide, the strip having first and second ends and front and rear edges and a second front wall 34, having a depressed central portion 34*c*, the wall being substantially the length of the second bottom and from about one-half to about one and one-half inches in width having a bottom edge which is secured along the front of the second bottom strip 32, a top edge and first and second ends so as to define a second compartment which may or may not be the same length as the first compartment. Third and fourth trapezoidal ends 36 and 38 each having a base edge, a top edge longer than the base edge, an altitude and front and rear edges, the base edges being secured at the respective ends of the bottom strip and the front edges being secured to the respective ends of the front wall complete the second compartment. The bottoms, ends and fronts are so constructed and dispose relative to each other that when the holder is mounted for use the front wall is disposed at an angle of from about fifteen to about 30 degrees from vertical and the second front extends upwardly from the second bottom and outwardly from the first front at an angle of from about 15 to about 30 degrees and the second front is disposed at an angle of from about 15 to about 50 degrees from vertical, each of the front walls configured for exposing the upper edge of combs received therein for easy grasping by the user. The bottoms and fronts are conveniently substantially the same length but it is also convenient to form a shorter second front compartment.

One important feature, though not absolutely essential, is the construction wherein the upper edge of the fronts are configured to define a central area therein which is lower than the ends for permitting easy grasping of a comb when the hold is in use.

Another very important, though not critical, feature is the construction wherein the altitude of one of the first and second ends and/or the altitude of one of the third and fourth ends is shorter than the altitude of the other of said ends, the second bottom, third and fourth ends and first and second fronts being so configured and constructed as to permit the handle a tail comb to extend over the shorter end out of the receptacle defined thereby.

Figure 4:
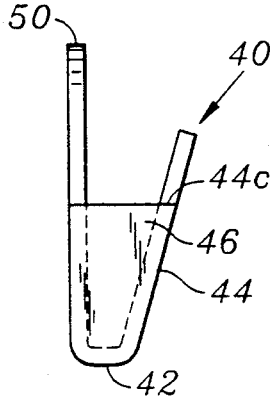
FIG. 4 is an end view of a basic version of the invention providing only one comb holding compartment.
Figure 5:
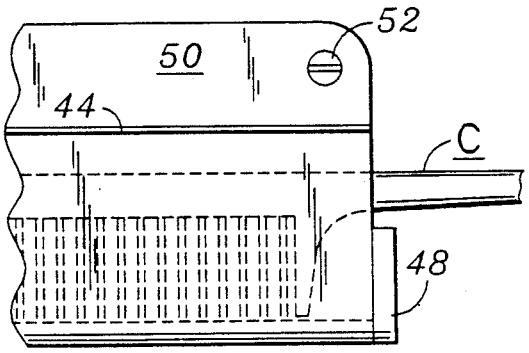
FIG. 5 is a partial front view of the version of the invention shown in FIG. 4 showing a tail comb being held therein, with the handle extended.

As depicted in FIGS. 4 and 5, it is not essential that the holder form two compartments, though this is greatly preferred. In the alternative embodiment of FIGS. 4 and 5, the holder 40 comprises a bottom strip 42, a front 44, ends 46 and 48 and a back 50 each of which is generally as described with the first bottom, front, ends and back in the embodiment of FIGS. 1–3. A screw 52 is depicted as exemplary of the great variety of fasteners which may used to mount the holder on the vertical wall inside the front of a drawer, on the sides of the drawer, or elsewhere.

While the invention may be formed of any materials which can be suitably formed and worked, it is convenient, in one embodiment to form the front of the drawer of bonded particles, using known resin-bonding technology, with the holder an integral part thereof. In another preferred technique the holder is formed of adhesively bonded plactic (polymeric) components, e.g. Lucite (trademark) or Plexiglas (trademark) polymethylmethacrylate resins, polystyrenes, polycarbonates, etc. The front wall of the drawer and/or the holder may also be injection molded of a thermoplastic resin.

Industrial Application

This invention is applicable for holding combs in domestic and industrial establishments, for use in holding combs for use by humans or on animals in the veterinary trades.

What is claimed is:

1. A combination drawer and comb holder comprising a generally vertical front wall, and a comb holder mounted thereupon for holding a hand comb which has a lower edge defined by protruding comb teeth and an upper edge defined by a back for grasping and holding the comb, the comb holder comprising:

(a) a first bottom comprising a narrow elongate bottom strip from about four to about ten inches long and from about 0.1 to about 0.4 inches wide, the strip having first and second ends and front and rear edges;

(b) a first front wall substantially the length of the first bottom and from about one-half to about one and one-half inches in width having a bottom edge secured along the front of the first bottom, a top edge and first and second ends;

(c) first and second trapezoidal end pieces each having a base edge, a top edge longer than the base edge, an altitude and front and rear edges, the base edges being secured at the repective ends of the first bottom and the front edges secured to the respective ends of the first front wall;

(d) means for mounting the rear edges of the first bottom and of the end pieces adjacent a generally vertical wall for use, the first bottom, end pieces and first front wall being so constructed and disposed relative to each other that when the holder is mounted for use the first front wall extends upwardly from the first bottom and outwardly from the vertical wall at an angle of from about 15 to about 50 degrees and defines an elongate receptacle for holding a comb therein lower edge down lying at an angle of from about 15 to about 50 degrees from vertical for exposing the upper edge for easy grasping by the user.

2. The drawer and comb holder of claim 1 wherein the upper edge of the first front wall is configured to define a central area therein which is lower than the ends for permitting easy grasping of a comb when the holder is in use.

3. The drawer and comb holder of claim 2 wherein the altitude of one end piece is shorter than the altitude of the other end piece, the first bottom, end pieces and first front wall being so configured and constructed as to permit the handle a tail comb to extend over the shorter end out of the receptacle defined by the first bottom, end pieces and first front wall.

4. The drawer and comb holder of claim 3 wherein further comprising:

(a) a second bottom comprising a narrow elongate strip from about four to about ten inches long and from about 0.1 to about 0.4 inches wide, the strip having first and second ends and front and rear edges;

(b) a second front wall substantially the length of the first bottom and from about one-half to about one and one-half inches in width having a bottom edge secured along the front of the second bottom, a top edge and first and second ends;

(c) third and fourth trapezoidal end pieces each having a base edge, a top edge longer than the base edge, an altitude and front and rear edges, the base edges being secured at the respective ends of the second bottom and the front edges secured to the respective ends of the second front wall;

(d) the second bottom, third and fourth end pieces and second front wall being so constructed and disposed relative to each other that when the holder is mounted for use the first front wall is disposed at an angle of from about fifteen to about 30 degrees from vertical and the second front wall extends upwardly from the second bottom and outwardly from the first front wall at an angle of from about 15 to about 30 degrees, the second bottom, third and fourth end pieces, first front wall and second front wall define a second elongate receptacle for holding a comb therein lower edge down lying at an angle of from about 15 to about 50 degrees from vertical for exposing the upper edge for easy grasping by the user.

5. The comb holder of claim 4 wherein the bottoms and fronts are substantially the same length.

6. The drawer and comb holder of claim 5 wherein the upper edge of the second front wall is configured to define a central area therein which is lower than the ends for permitting easy grasping of a comb when the holder is in use.

7. The drawer and comb holder of claim 6 wherein the altitude of one of the third and fourth ends is shorter than the altitude of the other of said ends, the second bottom, third and fourth ends and first and second fronts being so configured and constructed as to permit the handle a tail comb to extend over the shorter end out of the receptacle defined thereby.

* * * * *